US012735847B2

(12) United States Patent
Carrasco

(10) Patent No.: US 12,735,847 B2
(45) Date of Patent: Sep. 15, 2026

(54) ASPHALT PRODUCTION FACILITY AND METHOD FOR MAKING ASPHALT IN SUCH AN ASPHALT PRODUCTION FACILITY

(71) Applicant: ARGUMAT, Chaponnay (FR)

(72) Inventor: Antoine Carrasco, Marennes (FR)

(73) Assignee: ARGUMAT, Chaponnay (FR)

( * ) Notice: Subject to any disclaimer, the term of this patent is extended or adjusted under 35 U.S.C. 154(b) by 865 days.

(21) Appl. No.: 17/822,483

(22) Filed: Aug. 26, 2022

(65) Prior Publication Data

US 2023/0063289 A1 Mar. 2, 2023

(30) Foreign Application Priority Data

Aug. 26, 2021 (FR) ..... 2108925

(51) Int. Cl.
*E01C 19/10* (2006.01)

(52) U.S. Cl.
CPC ..... *E01C 19/1054* (2013.01)

(58) Field of Classification Search
CPC ..... E01C 19/1054; B01F 2101/38
See application file for complete search history.

(56) References Cited

U.S. PATENT DOCUMENTS

| | | | | |
|---|---|---|---|---|
| 4,025,057 | A * | 5/1977 | Shearer | E01C 19/1068 366/11 |
| 7,566,162 | B1 * | 7/2009 | Swanson | C08L 95/00 366/23 |
| 2020/0248410 | A1 * | 8/2020 | Crupi | E01C 19/1004 |
| 2023/0296319 | A1 * | 9/2023 | Johann | F26B 23/022 34/131 |

FOREIGN PATENT DOCUMENTS

| | | | |
|---|---|---|---|
| CN | 201488267 | U | 5/2010 |
| CN | 102518020 | A | 6/2012 |
| DE | 3538325 | A1 | 4/1987 |
| EP | 3412829 | A1 | 12/2018 |
| FR | 3051203 | A1 | 11/2017 |
| JP | 01214605 | A * | 8/1989 |
| JP | 2006045845 | A * | 2/2006 |

OTHER PUBLICATIONS

French Preliminary Search Report issued on Apr. 13, 2022 for application No. 2108925.

* cited by examiner

*Primary Examiner* — Marc C Howell
(74) *Attorney, Agent, or Firm* — Nath, Goldberg & Meyer; Joshua B. Goldberg

(57) ABSTRACT

The invention relates to an asphalt production facility (1) comprising:

Figure 1:
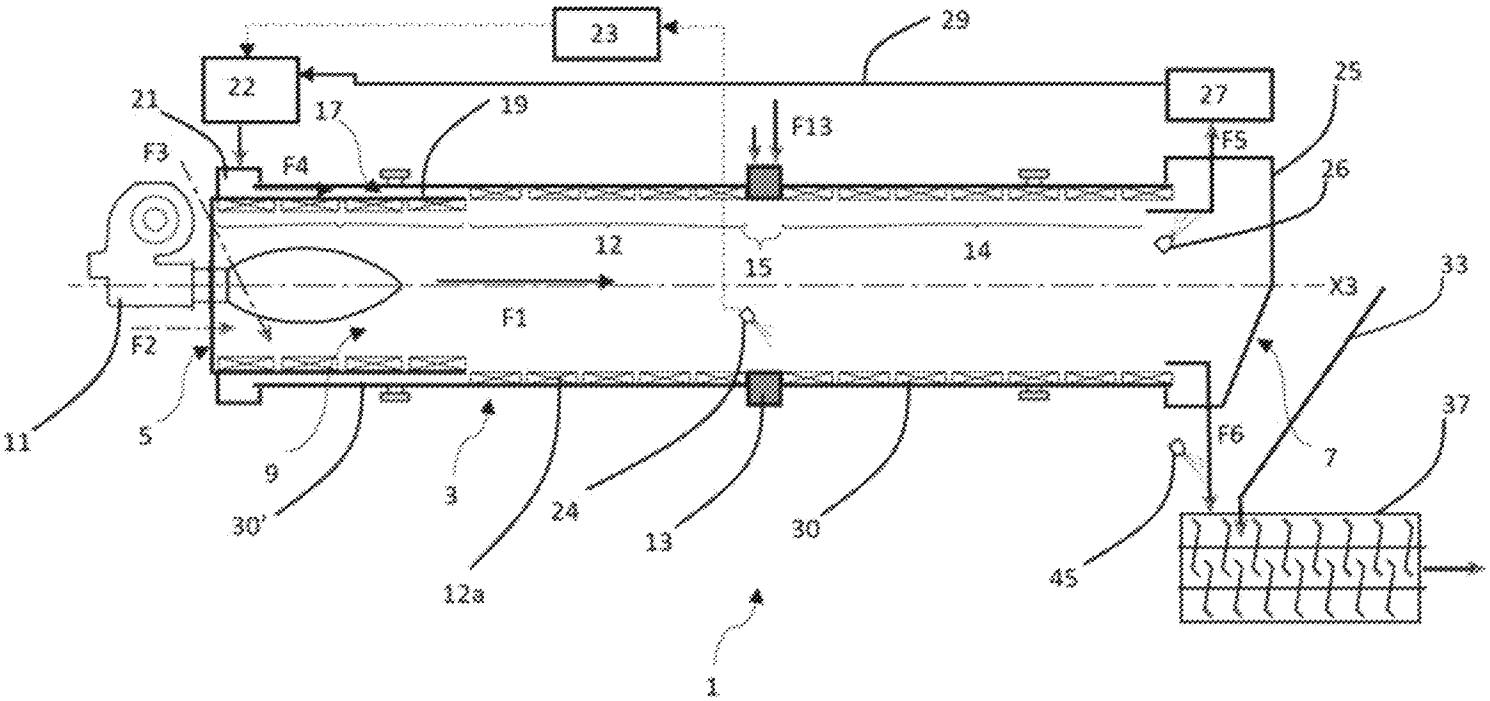

- a drum dryer (3),
- a combustion chamber (9),
- a burner (11) configured to generate a hot gas flow (F1) circulating in the drum dryer (3),
- at least one first device (13) for the introduction of asphalt aggregates to be recycled that defined at least one recycling area (15),
- a cooling channel (17) defined between a wall (19) of the combustion chamber (9) and an external envelope (30') of the drum (3),
- a device (21) for injection of a cooling fluid (F4) into the cooling channel (17), and
- a control and regulation system (23) for piloting the injection device (21) in such a way that the hot gas flow (F1) has a temperature that is lower than 700° C. in said recycling area (15).

A method for making asphalt in such asphalt production facility.

11 Claims, 3 Drawing Sheets

ASPHALT PRODUCTION FACILITY AND METHOD FOR MAKING ASPHALT IN SUCH AN ASPHALT PRODUCTION FACILITY

The present invention relates to the general technical field of asphalt production, in particular asphalt for road surface, with recycling of asphalt aggregates.

The present invention more particularly relates to an asphalt production facility, as well as a method for making asphalt in such an asphalt production facility.

To produce asphalt for road surface, it is known to dry and heat fresh granulates, then to mix the dry and hot granulates with binder, in particular bituminous binder. For that purpose, a rotary drum dryer is generally used, for example of the parallel-flow type, which comprises a first end through which are introduced fresh granulates, a combustion chamber in which is generated a flow of hot air capable of drying and heating the fresh granulates, and at least one drying area. The drum may possibly comprise a binder mixing area (it is then talked about a "drum dryer-mixer").

For environmental and cost reasons, it is known to mix to the fresh granulates asphalt aggregates, coming for example from torn road surface, to recycle used asphalt.

For that purpose, it is known to provide a drum dryer comprising a device for the introduction of asphalt aggregates to be recycled, located along the drum between the combustion chamber and the drying area.

For producing asphalt with asphalt aggregate recycling, it is generally searched to obtain a high recycling rate, to limit the quantity of fresh granulates used and to reduce the pollutant emissions produced by the asphalting process. The recycling rate is defined as the ratio between, on the one hand, the quantity of asphalt aggregate and, on the other hand, the sum of the quantity of asphalt aggregate and of the quantity of fresh granulate entering the composition of the final asphalt.

The use of asphalt aggregates requires controlling the temperature of the hot gas used for heating and drying the fresh granulates, to avoid that the heating of the asphalt aggregates to be recycled emits toxic volatile organic compounds and/or causes premature ageing of the bitumen. Now, the quantity of fresh granulates entering the composition of the final asphalt has an influence on the hot gas temperature: the higher the quantity of fresh granulate at the drum entry (and thus the lower the recycling rate), the more the hot gas flow cooled down at its arrival in the recycling area.

The objects assigned to the invention thus aim to remedy the above-mentioned drawbacks and to propose new asphalt production facility and method whose design allow producing asphalts with a high asphalt aggregate recycling rate while limiting the emission of pollutants.

Another object of the invention aims to propose new asphalt production facility and method making it possible to efficiently and rapidly lower down the temperature of the drum enclosure at the combustion chamber.

Another object of the invention aims to propose a new asphalt production facility of compact construction.

Another object of the invention aims to propose a new asphalt production facility having an excellent energy efficiency.

The objects assigned to the invention are achieved by means of an asphalt production facility comprising:

- a drum dryer comprising an elongated enclosure extending along a central axis, said drum dryer being mounted rotatable about the central axis, and having a first end for the introduction of fresh granulates and a second, opposite end forming an exit of the drum,
- a combustion chamber rotatably linked to the drum dryer,
- a burner configured to generate, in the combustion chamber, a hot gas flow circulating in the drum dryer from the first end to the second end,
- at least one first device for the introduction of asphalt aggregates to be recycled, arranged along the drum downstream from the combustion chamber and configured to allow the introduction of asphalt aggregates to be recycled into the drum, and which defines at least one first recycling area of the drum,
- a cooling channel surrounding at least partially the combustion chamber, said cooling channel being defined between a wall of the combustion chamber and an external envelope of the drum,
- a device for injection of a cooling fluid into the cooling channel, and
- a control and regulation system to pilot the cooling fluid injection device in such a way that the hot gas flow has a temperature that is lower than 700° C. in said first recycling area.

The objects assigned to the invention are achieved by means of a method for making asphalt in an asphalt production facility comprising:

- a drum dryer formed by an elongated enclosure extending along a central axis, said drum dryer being mounted rotatable about the central axis, and having a first end for the introduction of fresh granulates and a second, opposite end forming an exit of the drum,
- a combustion chamber rotatably linked to the drum dryer,
- a burner configured to generate, in the combustion chamber, a hot gas flow circulating in the drum dryer from the first end to the second end,
- at least one first device for the introduction of asphalt aggregates to be recycled, arranged along the drum downstream from the combustion chamber and configured to allow the introduction of asphalt aggregates to be recycled into the drum, and which defines a first recycling area of the drum,
- a cooling channel surrounding at least partially the combustion chamber, defined between a wall of the combustion chamber and an external envelope of the drum,
- a device for injection of a cooling fluid into the cooling channel, said method comprising a step consisting in piloting said cooling fluid injection device in such a way that the hot gas flow has a temperature that is lower than 700° C. in said first recycling area.

Other features and advantages of the invention will appear in more detail upon reading of the following description, with reference to the appended drawings, given by way of purely illustrative and non-limiting examples, in which:

FIG. 1 schematically illustrates a first embodiment of an asphalt production facility according to the invention.

Figure 2:
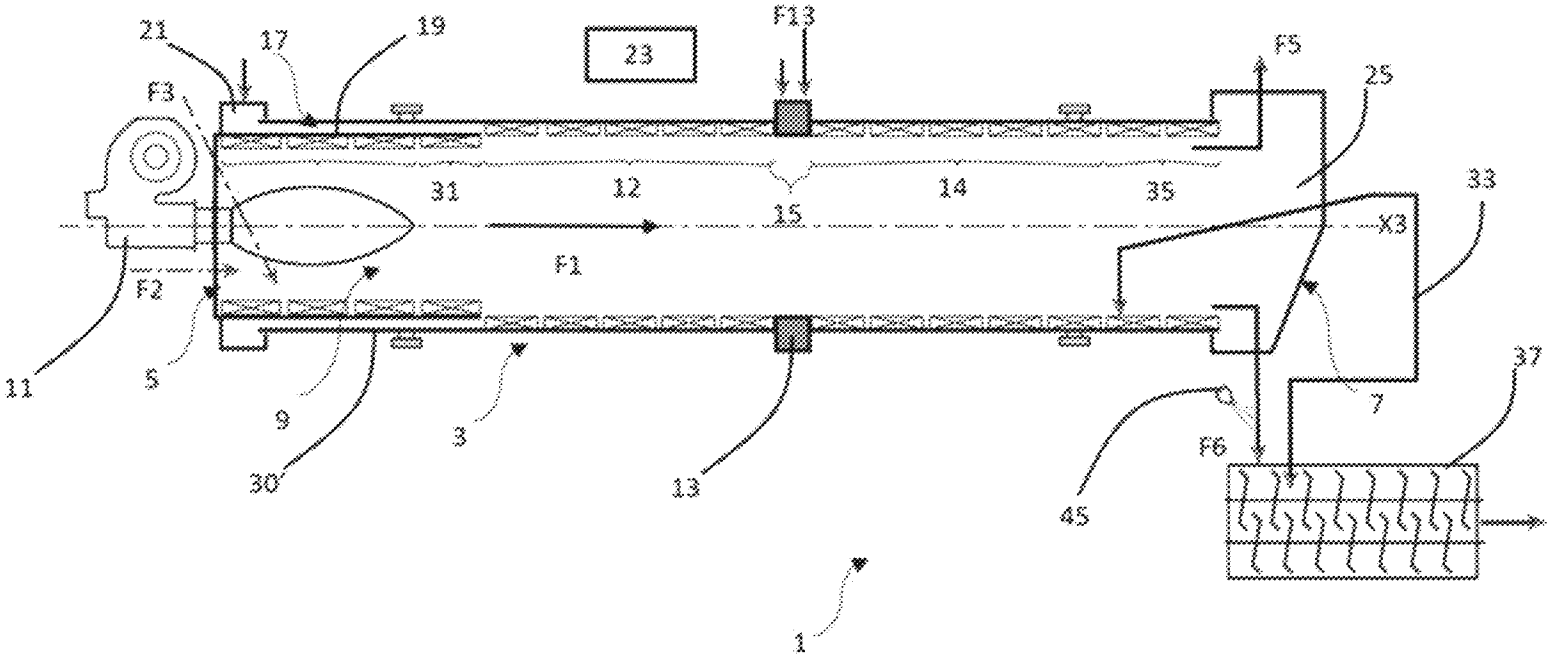

FIG. 2 schematically illustrates a second embodiment of an asphalt production facility according to the invention.

Figure 3:
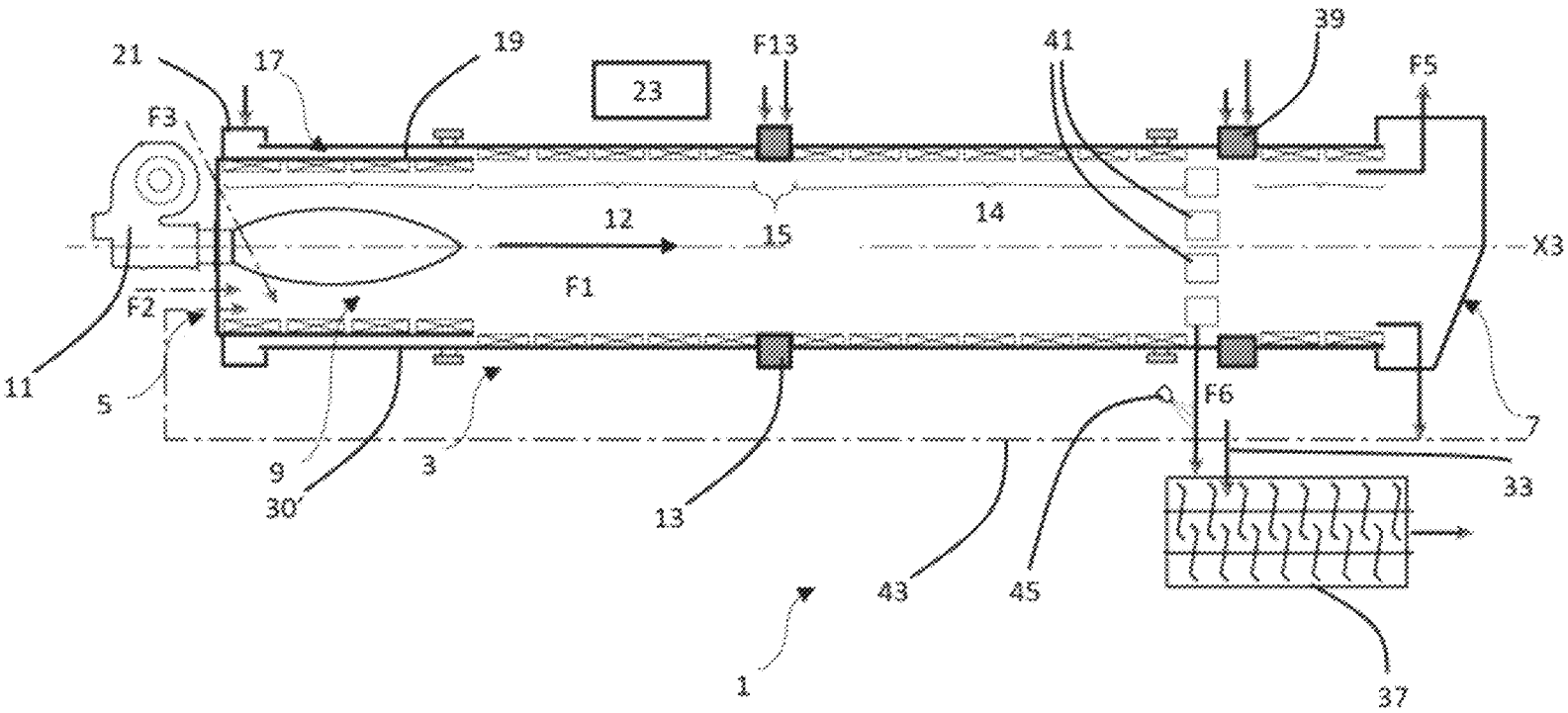

FIG. 3 schematically illustrates a third embodiment of an asphalt production facility according to the invention.

The invention relates to a facility 1 for producing asphalt, intended for example to road surfacing.

Hereinafter, the term "fresh granulate" denotes a new granulate, generally wet and cold and that has not yet been used in the production of asphalt, and that has therefore never been dried, heated or mixed with a binder.

The facility 1 comprises a drum dryer 3, which comprises an elongated enclosure 30 extending along a central axis X3, this drum dryer 3 being mounted rotatable about the central axis X3. The drum dryer 3 has a first end 5 for the introduction of fresh granulates and a second end 7, opposite along the central axis X3, forming an exit of the drum dryer 3. The central axis X3 is represented horizontal in the Figures. In practice, it is current that the central axis X3 is slightly inclined with respect to the horizontal, in such a way that the granulates are driven by gravity from the first end 5, which then forms a raised end, to the second end 7, which then forms a lowered end. The travel direction of the granulates from the first end 5 to the second end 7 defines the advance direction of the granulates. Hereinafter, with reference to the advance direction, the terms "upstream" and "downstream" are used, respectively, to qualify elements oriented towards the first end 5 and the second end 7, respectively.

The installation 1 also comprises a combustion chamber 9 rotatably linked to the drum dryer 3. In other words, the combustion chamber 9 is integral with the drum dryer 3 in its rotational motion about the axis X3.

The installation 1 also comprises a burner 11 configured to generate, in the combustion chamber 9, a hot gas flow, represented by arrow F1, circulating along the central axis X3 in the drum dryer 3 from the first end 5 to the second end 7. Advantageously, the circulation of the granulates and the hot gas flow F1 is "co-flow", that is to say in the same direction along the central axis X3 of the drum dryer 3. The drum dryer thus advantageously forms, as illustrated, a parallel-flow or co-flow drum dryer. The burner 11 is advantageously fixed with respect to the drum dryer 3, that is to say that the burner 11 is not integral with the drum 3 in rotation about the axis X3.

In the vicinity of the first end 5, the facility 1 comprises a system for the introduction of fresh granulates into the drum dryer 3. The introduction of fresh granulates is made into the combustion chamber 9. The introduction may be made in a horizontal direction, for example with a conveyor belt, according to arrow F2, or in an inclined direction, for example with a chute, according to arrow F3.

The installation 1 also comprises at least one first device 13 for the introduction of asphalt aggregates to be recycled, arranged along the drum 3 downstream from the combustion chamber 9 and configured to allow the introduction of asphalt aggregates to be recycled into the drum 3. This introduction device 13 is preferably formed by a part protruding from the enclosure 30, having holes for the introduction of asphalt aggregates, and communicating with the inside of the drum 3 through holes formed through the enclosure 30. The introduction device 13 may have the shape of a ring surrounding the drum 3, and may be rotationally integral or not with the drum 3 about the axis X3. The introduction device 13 defines a first recycling area 15 of the drum 3, that is to say the part of the drum 3 that extends according to axis X3 along the introduction device 13, and in which the asphalt aggregates to be recycled can be poured into the drum 3 along a direction materialized for example by arrow F13.

Between the combustion chamber 9 and the introduction device 13, the drum 3 comprises a first drying area 12, that is to say a section of the drum 3 provided, for example, with lift blades 12*a* fastened to an inner face of the enclosure 30, and specifically designed to lift the granulates and to spill them into the drum 3, thus forming a curtain through which the hot gas flow F1 circulates, in such a way as to generate a heat exchange making it possible to dry and/or heat the granulates.

The drum 3 also comprises a second drying area 14 located between the introduction device 13 and the second end 7, which second drying area 14 may be or not provided with lift blades, and be for example devoid of lift blades but provided with mixing blades to ensure the mixing of the fresh granulates and the granulates to be recycled.

The passage of the hot gas flow F1 in the two successive drying areas 12 and 14 induces a progressive decrease of temperature of the hot gas flow F1 downstream the drum 3.

The installation 1 also comprises a cooling channel 17 surrounding at least partially, and preferably totally, the combustion chamber 9. The drum dryer 3 comprises for example an internal sleeve, that is to say an elongated tubular element, arranged coaxially to the drum 3 and inside the enclosure 30 of the drum dryer 3 and that forms a wall 19 of the combustion chamber 9. Along the combustion chamber 9, the drum 3 comprises an external envelope 30'. The radial space defined between the wall 19 and the external envelope 30' advantageously forms the cooling channel 17. By way of example, the radial space between the wall 19 and the external envelope 30' may be of 20 to 300 mm. In the embodiments illustrated in the figures, the cooling channel 17 has an annular shape centred on the central axis X3. Preferably, the cooling channel 17 extends longitudinally between an upstream end (located preferably at the first end 5) and a downstream end, over a length (measured along the longitudinal axis X3) that corresponds to at least 50%, preferably at least 80%, and even more preferably substantially 100%, of the length of the combustion chamber 9, within which extends longitudinally, preferably over substantially the whole length of the combustion chamber 9, the flame generated by the burner 11. Advantageously, the cooling channel 17 surrounds the combustion chamber 9 without communicating with the latter over the whole length of said cooling channel 17, that is to say that the cooling fluid present within the cooling channel 17 does not substantially enter into contact with the flame and/or with the hot gas flow F1 over the length of the wall 19. For that purpose, said wall 19 is advantageously formed by a solid wall, sealed against the cooling fluid (which is preferably a gas), in such a way that the cooling fluid cannot pass through said wall 19 in the thickness thereof, over the whole length of said wall 19. Therefore, preferably, the cooling channel 17 has substantially no communication with the combustion chamber 9 between its upstream and downstream ends, and it opens for example to the inside of the enclosure 30 only at said downstream end, which makes it possible to introduce the cooling fluid into the enclosure 30 essentially beyond the combustion chamber 9, thus avoiding disturbing the combustion, while ensuring a particularly efficient cooling of the external envelope 30'.

In the example shown, the external envelope 30' is single-piece with the enclosure 30 of the drum 9, and the wall 19 of the combustion chamber 9 is formed by an internal sleeve of the enclosure 30. As an alternative not shown, it may be contemplated that the wall 19 of the combustion chamber 9 is single-piece with the enclosure 30, and that the external envelope 30' is a sleeve, a jacket, or generally an elongated tubular element arranged around the enclosure 30.

The installation 1 also comprises a device 21 for injecting a cooling fluid, represented by arrow F4, into the cooling channel 17. The cooling fluid may be in particular a gas or gaseous mixture, for example, ambient air captured outside the drum 3. According to an alternative not shown, the cooling fluid can also be a liquid. Said injection device 21 is preferentially located at said downstream end and the first end 5, as illustrated in the figures.

The installation 1 also comprises a control and regulation system 23 to pilot the injection device 21 in such a way that the hot gas flow F1 has, in the first recycling area 15, a temperature that is lower than 700° C. The cooling fluid flow rate is controlled in such a way that the temperature of the hot gas flow F1 measured in the first recycling area 15 remains lower than 700° C. If the temperature measured is higher than 700° C., the cooling fluid flow rate is increased until the temperature measured is lower than 700° C.

The cooling fluid circulation in the cooling channel 17 has for effect to cool by conduction the wall 19, and thus the hot gas flow F1 that circulates in the combustion chamber 9. A part of the heat of the hot gas flow F1 is captured by the wall 19, which makes it possible to lower down the temperature of the hot gas flow F1. Therefore, the asphalt aggregates to be recycled are not exposed to a too high temperature in the recycling area 15, which could degrade them by emitting harmful emissions.

Moreover, the implementation of the cooling channel 17 makes it possible to lower down the temperature of the enclosure 30 (and in particular the external face of the wall forming said enclosure) along the combustion chamber 9, in such a way that the latter can be, by way of example, lower than 450° C. It is therefore possible to avoid a too significant radiation, and to place devices on the enclosure 30 and on the external envelope 30', such as, for example, a tread, sensors, devices for control, for fluid injection, for granulate conveying, which is not possible if the temperature of the enclosure 30 along the combustion chamber 9 is too high.

In the example shown, the cooling fluid is gaseous, and is formed for example by a gaseous mixture. Advantageously, the cooling channel 17 opens downstream into the drum 3 at the end of the wall 19, downstream from the combustion chamber 9. The major part, and preferably almost all or all the gaseous cooling mixture is then injected into the drum 3, downstream from the combustion chamber 9, after having circulated in the cooling channel 17. The gaseous cooling mixture is not injected directly into the combustion chamber 9 in order to avoid a degradation of the combustion and the emission of pollutants, and to allow optimizing the cooling of the external envelope 30'. The hot gas flow F1 downstream from the combustion chamber 9 is formed of a mixture comprising in part the gas flow heated in the combustion chamber 9 and in part the cooling gas flow. Such an arrangement makes it possible to further lower down the temperature of the hot gas flow F1.

In the case where the cooling fluid is a cooling liquid, the cooling channel 17 does not open downstream into the drum 3 at the end of the wall 19 and the cooling liquid is thus not injected into the drum 3.

Advantageously, the installation 1 can comprise a flow regulator 22 controlling the cooling fluid flow rate entering the cooling channel 17. The flow regulator 22 is advantageously controlled by a piloting signal emitted by the control and regulation system 23. Advantageously, the installation 1 can include a temperature sensor 24 for measuring the temperature of the hot gas flow F1 in the first recycling area 15, and transmitting a measurement signal to the control and regulation system 23.

Advantageously, the control and regulation system 23 is configured to maintain the temperature of the hot gas flow F1 in the first recycling area substantially between 600° C. and 650° C.

Advantageously, the control and regulation system 23 may be configured to maintain the temperature of the hot gas flow F1 below 220° C. at the exit of the drum dryer 3. Lowering the exit temperature of the hot gas flow F1 below 220° C. allows reducing the emissions of polluting gas. For that purpose, the installation may comprise a temperature sensor 26 configured to communicate a measurement signal to the control and regulation system 23.

Advantageously, the control and regulation system 23 pilots the injection device 21 in such a way that the hot gas flow F1 has at the exit of the drum dryer 3 a temperature that is lower than 220° C. The cooling fluid flow rate is controlled in such a way that the temperature of the hot gas flow F1 measured at the exit of the drum dryer 3 remains lower than 220° C. If the temperature measured is higher than 220° C., the cooling fluid flow rate is increased until the temperature measured is lower than 220° C.

Advantageously, the cooling fluid can comprise at least in part a gas or a gaseous mixture, represented by arrow F5, coming from the exit of the drum dryer 3. In such a case, the installation 1 comprises a device 25 for recovering the gas at the exit of the drum 3, and a circuit for conveying said gas to the cooling fluid injection device 21. The recovery device 25 captures the gas exiting from the drum through the second end 7, for example by means of a vacuum system, a collector or a chimney, advantageously directs them towards a filtration device 27, then towards the conveying circuit formed by a duct 29 connecting the filtration device 27 and the flow regulator 22.

According to an optional embodiment shown in FIG. 2, the drum 3 can comprise a drying area 31 defined by a downstream section of the combustion chamber 9, for performing a first lifting as a curtain of granulates, and drying and/or heating them with the hot gas flow F1 when the latter is at high temperature.

Advantageously, the installation 1 comprises a binder supply device 33 and a mixing device configured to mix the binder with hot and dried asphalt at the exit of the drum 3. The binder is generally a bitumen.

The mixing device can comprise a mixer 37 external to the drum 3, as shown in FIG. 1. The mixer 37 generally comprises a casing in which are operated rotary elements mixing the heated and dried granulates with the binder. The heated and dried granulates exiting from the drum 3 are poured into the mixer 37 according to arrow F6.

According to an optional aspect, the installation 1 can comprise a temperature sensor 45 configured to measure the temperature of the mixing of asphalt and aggregates exiting from the drum 3, in order to verify that the latter is at a temperature adapted for the phase of mixing with the binder. Advantageously, the temperature sensor 45 can be configured to communicate with the control and piloting system 23 to pilot the operation of the installation 1 as a function of the temperature value measured by the temperature sensor 45.

As an alternative, instead of the external mixer 37 or as a supplement of the latter, the mixing device can comprise a mixing area 35 defined by the drum 3 between the second drying area 14 and the second end 7. The mixing area 35 differs from the drying areas 12 and 14 by the fact that the blades that are fastened to the inner face of the enclosure 30 are specifically designed to obtain a homogeneous mixture between the dried and heated granulates and the binder.

In the case where the mixing device comprises an external mixer 37, the hot and dried granulates are poured at the exit of the drum 3 into the external mixer 37 and the binder supply device 33 is configured to convey the binder into the external mixer 37. In the case where the mixing device comprises a mixing area 35 defined by the drum 3, the binder supply device 33 is configured to convey the binder into the mixing area 35. In the case where the mixing device comprises both an external mixer 37 and a mixing area 35 defined by the drum 3, the binder supply device 33 is configured to convey the binder both into the mixing area 35 and into the external mixer 37. The binder supply device 33 comprises for that purpose binder supply elements, in particular ducts or chutes.

According to an optional embodiment, the drum 3 can comprise at least one second device (not illustrated) for the introduction of asphalt aggregates to be recycled, arranged along the drum 3 downstream from the first device 13 for the introduction of asphalt aggregates to be recycled, and configured to allow the introduction of an additional quantity of asphalt aggregates to be recycled into the drum 3. The two introduction devices are spaced apart along the central axis X3. The presence of two devices for the introduction of asphalt aggregates to be recycled allows incorporating to the asphalt obtained two asphalt aggregates to be recycled of different characteristics, for example of different particle sizes. For example, the asphalt aggregates to be recycled introduced by the first introduction device 13 can be of coarse particle size, and the asphalt aggregates to be recycled introduced by the second introduction device can be of finer particle size.

According to another optional embodiment shown in FIG. 3, the drum 3 can comprise at least one additional device 39 for the introduction of fresh granulates and/or asphalt aggregates to be recycled, arranged along the drum 3 downstream from the first device 13 for the introduction of asphalt aggregates to be recycled. The additional device 39 for the introduction of fresh granulates and/or asphalt aggregates to be recycled is advantageously implanted near the exit of the drum 3, which makes it possible to ensure a function of potential cooling of the hot gas flow at the exit of the drum by heat exchange with fresh granulates and/or asphalt aggregates to be recycled, thus allowing energy recovery in the hot gas.

Advantageously, the drum 3 can also comprise openings 41, which put the inside of the drum 3 in communication with the outside, through the enclosure 30, and which are located upstream from the second introduction device 39. The openings 41 being configured to allow the hot and dried granulates produced upstream from the second introduction device 39 to be poured out of the drum 3.

Advantageously, the hot and dried granulates produced upstream from the second introduction device 39 are poured into the external mixer 37.

According to an optional embodiment shown in FIG. 3, it may be contemplated that the installation comprises a system 43 for recovering a mixture comprising the dried and heated granulates and the asphalt aggregates at the exit of drum 3 and returning this mixture to the first end 5 of the drum 3, where this mixture is introduced into the latter and undergoes a new drying and heating phase. The system 43 can for that purpose comprise a conveyor or a belt. Such a return of the mixture at the exit of the drum 3 can be contemplated when the quality of the mixture and/or the temperature thereof are insufficient for the binder to be incorporated, in order to avoid any useless loss of binder and/or granulates.

According to an embodiment not shown, the drum 3 may not include a second introduction device 39, and the openings 41 may be placed upstream from the mixing area 35 and thus form a bypass channel for pouring all or part of the hot and dried granulates out of the drum 3, for example towards a conveyor not shown.

The first and second devices 13 and 39 for the introduction of asphalt aggregates to be recycled can also be used to introduce, into the drum 3, fillers ("fines") or additives, that is to say complement materials of various natures entering the composition of the final asphalt.

The invention also relates to a method for making asphalt, preferably in an asphalt production facility 1 according to the invention. The preceding description relating to the installation 1 thus applies, mutatis mutandis, to the method according to the invention, and reciprocally. Said method comprises a step consisting in piloting the cooling fluid injection device 21 in such a way that the hot gas flow F1 has a temperature that is lower than 700° C. in the first recycling area 15.

The technical characteristics of the embodiments and alternatives described hereinabove can be combined together to form new embodiments within the framework defined by the claims.

The invention claimed is:

1. An asphalt production facility comprising:

a drum dryer comprising an elongated enclosure extending along a central axis, the drum dryer being mounted rotatable about the central axis, and having a first end for introducing into the drum dryer fresh granulates and a second, opposite end forming an exit of the drum dryer, a combustion chamber rotatably linked to the drum dryer, wherein the combustion chamber is configured to introduce the fresh granulates into the drum dryer, a burner configured to generate in the combustion chamber a flame axially extending over a whole length of the combustion chamber and configured to generate a hot gas flow circulating in the drum dryer from the first end to the second end, an injection device for injecting a gaseous cooling fluid into a cooling channel which surrounds at least partially the combustion chamber and which is radially defined between a wall of the combustion chamber and an external envelop of the drum dryer, the cooling channel axially extending over the whole length of the combustion chamber and ending within the drum dryer downstream of the combustion chamber whereby all of the gaseous cooling fluid injected by the injection device cools by conduction said wall of the combustion chamber and said external envelop before coming into contact and mixing with the hot gas flow downstream from the flame and the combustion chamber, at least one first introduction device for introducing into the drum dryer asphalt aggregates to be recycled, the at least one first introduction device being arranged along the drum dryer, downstream from the combustion chamber and defining at least one first recycling area of the drum dryer downstream from the combustion chamber and upstream from the exit of the drum dryer, the at least one first recycling area being configured to receive the asphalt aggregates to be recycled received from the at least one first introduction device and exposed to the hot gas flow mixed with all the gaseous cooling fluid injected by the injection device, and a control and regulation system for piloting the injection device in such a way that the hot gas flow mixed with all of the gaseous cooling fluid injected by the injection device has a temperature that is lower than 700° C. in the at least one first recycling area.

2. The asphalt production facility according to claim 1, wherein the control and regulation system is configured to maintain the temperature of the hot gas flow mixed with all the gaseous cooling fluid injected by the injection device between 600° C. and 650° C. in the at least one first recycling area.

3. The asphalt production facility according to claim 1, wherein the control and regulation system is configured to maintain the temperature of the hot gas flow mixed with all of the gaseous cooling fluid injected by the injection device below 220° C. at the exit of the drum dryer.

4. The asphalt production facility according to claim 1, wherein the gaseous cooling fluid comprises a gaseous mixture coming from the exit of the drum dryer, and wherein the asphalt production facility comprises a recovering device for recovering the gaseous mixture at the exit of the drum dryer, and a circuit for conveying the gaseous mixture to the injection device.

5. The asphalt production facility according to claim 1, wherein on a downstream side, the combustion chamber defines a drying area.

6. The asphalt production facility according to claim 1, wherein the asphalt production facility comprises a supply device for supplying a binder and a mixing device configured to mix the binder with hot and dried granulates at the exit of the drum dryer, and wherein the mixing device comprises a mixing area of the drum dryer and/or a mixer-external to the drum dryer, in which are poured the hot and dried granulates at the exit of the drum dryer, and wherein the supply device is configured for conveying the binder into said mixing area of the drum dryer and/or into said mixer.

7. The asphalt production facility according to claim 1, wherein the drum dryer comprises at least one second introduction device for introducing into the drum dryer asphalt aggregates to be recycled, the at least one second introduction device being arranged along the drum dryer downstream from the at least one first introduction device, and being configured to introduce an additional quantity of asphalt aggregates to be recycled into the drum dryer.

8. The asphalt production facility according to claim 7, wherein the drum dryer comprises openings located upstream from the at least one second introduction device, these openings being configured to allow hot and dried granulates produced upstream from the at least one second introduction device to be poured out of the drum dryer.

9. The asphalt production facility according to claim 1, wherein the control and regulation system is configured to maintain a temperature of the external envelope lower than 450° C.

10. The asphalt production facility according to claim 1, wherein the control and regulation system is configured to maintain a temperature of the hot gas flow mixed with all of the gaseous cooling fluid injected by the injection device above 600° C. in the at least one first recycling area.

11. A method for making asphalt comprising:

providing an asphalt production facility including:

a drum dryer including an elongated enclosure extending along a central axis, said drum dryer being mounted rotatable about the central axis, and having a first end for introducing into the drum dryer fresh granulates and a second, opposite end forming an exit of the drum dryer, a combustion chamber rotatably linked to the drum dryer, and configured to introduce the fresh granulates into the drum dryer, a burner configured to generate in the combustion chamber a flame axially extending over a whole length of the combustion chamber and configured to generate a hot gas flow circulating in the drum dryer from the first end to the second end, an injection device for injecting a gaseous cooling fluid into a cooling channel surrounding at least partially the combustion chamber and which is radially defined between a wall of the combustion chamber and an external envelop of the drum dryer, the cooling channel axially extending over the whole length of the combustion chamber and ending within the drum dryer downstream of the combustion chamber whereby all of the gaseous cooling fluid injected by the injection device cools by conduction said wall of the combustion chamber and said external envelop before coming into contact and mixing with the hot gas flow downstream from the flame and the combustion chamber, and at least one first introduction device for introducing into the drum dryer asphalt aggregates to be recycled, the at least one first introduction device being arranged along the drum dryer downstream from the combustion chamber and defining at least one first recycling area of the drum dryer downstream from the combustion chamber and upstream from the exit of the drum dryer the at least one first recycling area being configured to receive the asphalt aggregates to be recycled received from the at least one first introduction device and exposed to the hot gas flow mixed with all the gaseous cooling fluid injected by the injection device; and piloting the injection device in such a way that the hot gas flow mixed with all of the gaseous cooling fluid injected by the injection device has a temperature that is lower than 700° C. in the at least one first recycling area.

* * * * *